US005170960A

United States Patent [19]

Pretto

[11] Patent Number: 5,170,960

[45] Date of Patent: Dec. 15, 1992

[54] EXPANDING WINDING HEAD FOR WINDING ROLLS

[76] Inventor: Alessio G. Pretto, Wilkinson Hollow Rd., Pawling, N.Y. 12564

[21] Appl. No.: 714,707

[22] Filed: Jun. 13, 1991

[51] Int. Cl.[5] ..... B65H 75/24

[52] U.S. Cl. ..... 242/72.1

[58] Field of Search ..... 242/72.1, 72, 46.4, 242/46.2, 68.2; 279/2 R

[56] References Cited

U.S. PATENT DOCUMENTS 1,627,729 5/1927 Dingee ..... 242/72.1
2,908,452 10/1959 Jacobsen ..... 242/72 R
3,079,102 2/1963 Douglas ..... 242/72.1
3,963,250 6/1976 Flagg ..... 242/72 R X
4,142,690 3/1979 Karle et al. ..... 242/72.1 X

*Primary Examiner*—Stanley N. Gilreath

[57] ABSTRACT

According to the invention a winding head (1,40) is realized with expanding sectors (15,41) for the rotation of a tubular center (23,44) around which a tape (26) is wound.

The sectors (15,41) are radially forced against the internal surface (22,43) of the tubular center (23,44) by means of the radial movement of splines (9) and of rolling elements (17) placed on horizontal surfaces (11) of the splines (9). Said rotation is caused by the rotation of the sectors (15,41) to which said rolling element belong, caused by the tension (27) of the tape (26) being wound around the tubular center (23,44).

5 Claims, 3 Drawing Sheets

EXPANDING WINDING HEAD FOR WINDING ROLLS

BACKGROUND OF THE INVENTION

The present invention concerns the construction of an expanding winding head that is particularly suitable for winding paper tape into rolls.

Winding heads with expanding elements for winding paper tape into rolls are already known in the art. The heads of their expanding elements are inserted into a tubular centre ends around which the paper is wound and the winding heads are connected to a drive shaft that rotates them thus winding the paper tape around the tubular centre and forming a roll.

One type of pneumatic expanding winding head of a known type consists of an essentially cylinder shaped external body with an internal cylindrical chamber in which there is a compressed-air operated piston whose rod runs axially inside a tubular spindle that is rigidly connected to the external body. The end of the tubular centre around which the paper is wound is caused to adhere to the tubular spindle by the radial force applied by sectors with grooved external surface against its internal surface of the spindle, which are externally coaxial with the tubular spindle. These sectors are moved by splines that are themselves radially moved when the piston is moved in an axial direction.

The degree of gripping between the tubular centre on which paper is wound and the sectors with a grooved external surface coaxial with the tubular spindle, depends on the extension of the surfaces which are in mutual contact, and increases the further the aforementioned surfaces are extended.

When the internal diameter of the tubular centre on which paper is wound and the external diameter of the tubular spindle with the sectors as above are of a considerable size, a sufficiently high degree of adherence is obtained so that, when the expanding spindle is rotated, the tubular centre is also rotated without slipping against the grooved sections. When the aforementioned diameters are below a certain minimum size, the size of the surfaces in mutual contact is also reduced and the degree of force with which these surfaces are pressed together is also reduced because the diameter of the piston running axially inside the external body of the winding head is diminished. In this case, due to the reduction both in the size of the surfaces in mutual contact and the pressure with which these surfaces are pressed together, there may be a degree of slipping between the two surfaces during rotation as it cannot be ensured that the tubular centre grips the tubular spindle.

This is one of the limitations of the pneumatic expanding spindles of a known type described above, as some manufacturers of paper rolls use tubular centres with a small diameter.

It should be pointed out that the external diameter of the external body of the winding head cannot be larger than the external diameter of the tubular centre on which the roll is wound; in fact, during the initial stages of winding, the paper type is caused to adhere to the tubular centre by a pressure roller belonging to the machine producing the tape, that glues the end of the tape to the tubular centre. During winding, this roller remains in contact with the roll and keeps it compact. It can thus be seen that if the external diameter of the tubular centre were smaller than the external diameter of the external body of the expanding winding head, the pressure roller used in the initial stages of winding would be prevented from touching the tubular centre.

SUMMARY OF THE INVENTION

In order to overcome these problems, the main aim of the present invention is the construction of an expanding pneumatic spindle capable of rotating a tubular centre gripping a tubular spindle, without any relative rotation between the aforementioned centre and aforementioned spindle during winding, even when their diameters are of a limited size.

A further aim is that this relative rotation is avoided although the external diameter of the external body of the winding head is of the same size as the external diameter of the tubular centre used, whatever size the external diameter of the tubular centre is used.

Another aim of the invention is the construction of an expanding pneumatic winding head which, for the same size of expanding pneumatic winding head as that of a known type, increases the degree of adherence between the tubular centre on which the roll is wound and the tubular spindle with expanding sections internally coupled to the tubular spindle.

The above described aims are achieved by the construction of an expanding winding head that is particularly suited for winding paper in rolls, and which comprises:

- an external body, essentially cylindrical in shape, with a tang at one end that couples to a driveshaft and a cylindrical chamber in which the end flange of a tubular spindle with radial slits is fitted;
- a number of splines each fitted into a slit in the aforementioned tubular spindle, and with an angled face facing the interior wall of the tubular spindle, and a horizontal face facing the exterior wall of the tubular spindle;
- a number of sectors with a grooved external surface with an arc shaped cross-section, that are each coaxially externally attached to the tubular spindle in correspondence to one of the aforementioned splines, these sections being suited to grip the interior of a tubular centre on which a roll is wound;
- a piston housed and running in an axial direction within the cylindrical chamber in the external body, with a piston rod that runs within the interior of the tubular spindle, this piston rod having angled surfaces on its end that act against the corresponding angled surfaces on the splines;
- means for driving the piston, wherein it includes rolling elements attached to the sections and placed between the aforementioned sections and the horizontal surfaces of the splines, where the radial force of the sectors against the internal surface of the tubular centre is obtained by the radial movement of the splines caused by the axial movement of the piston rod combined with the radial movement of the aforementioned rolling elements when they are caused to roll on the horizontal face of the spline, against which they buck the rotation of the sections around the axis of the winding head, this rotation being caused by the tension of the tape being wound around the tubular centre.

In a preferred embodiment of the invention, the tubular spindle has three radial cavities set at 120 degrees from each other, within each of which there runs a spline with an angled face facing the interior of the tubular spindle, and a horizontal face facing the exterior of the spindle.

Between the horizontal face on each spline and the sector with a grooved external surface, there is a rolling element consisting of a cylindrical roller whose lengthwise axis is parallel to the horizontal face of the spline, and which is fitted into a housing in the sector with a grooved external surface. The radial movement of the splines, both in expansion and return, is obtained by forcing angled surfaces on the end of a piston rod connected to a compressed-air piston against the relative angled face on each spline.

In a variation to the above embodiment, although compressed-air is used to move the piston and cause the splines to expand, the piston is returned and the splines thus retracted by the action of a spring against the end of the piston rod.

BRIEF DESCRIPTION OF THE DRAWINGS

The above described aims are further explained in the description of a favoured embodiment of the invention that follows, which is solely for the purpose of illustrating the invention and to which it is not limited, and the attached figures, in which.

Figure 1:
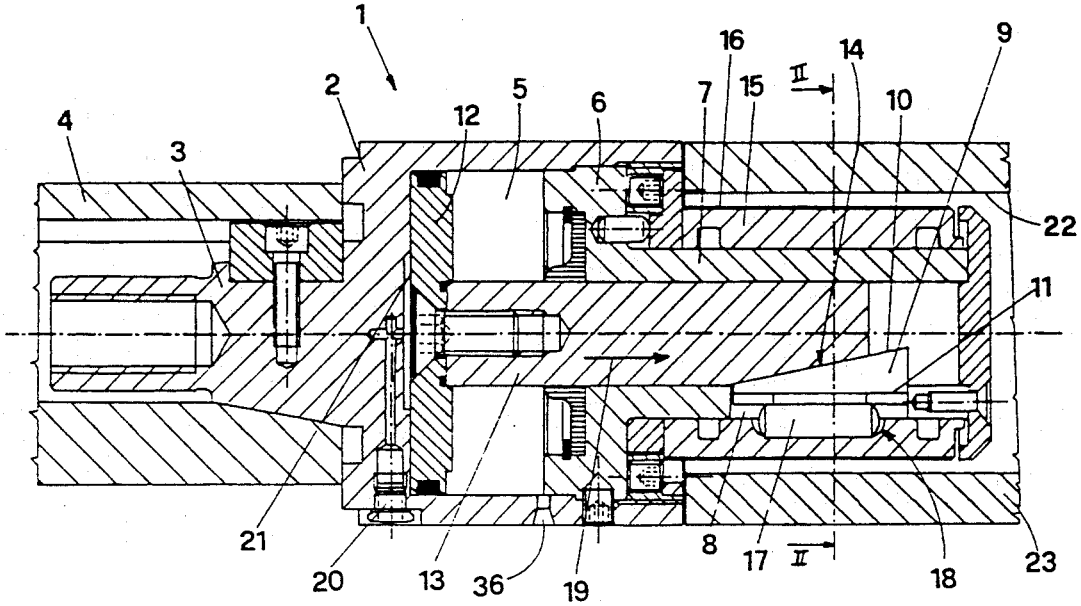
FIG. 1 is a lengthwise cross-section of a winding head according to the invention, in its rest position.
Figure 2:
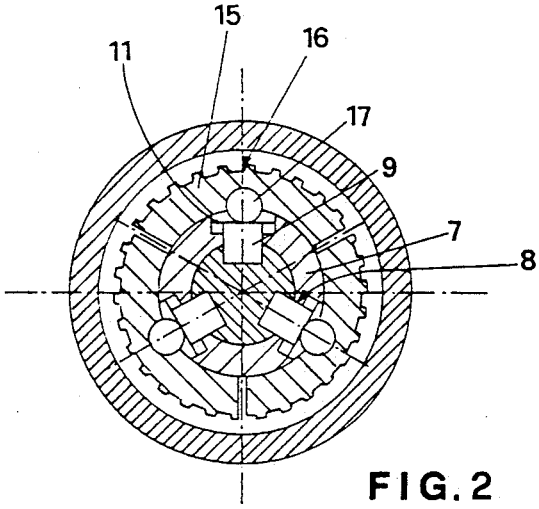
FIG. 2 is a transverse cross-section from II to II line of the winding head according to the invention shown in FIG. 1.

As can be seen from FIG. 1, the expanding pneumatic winding head according to the invention indicated in its entirely by 1 is composed of an external body 2, whose shape is essentially cylindrical, with a tang 3 at one end that is coupled to a drive shaft 4; the external body 2 presents a cylindrical chamber 5 within which fits the end flange 6 of a tubular spindle 7 with radial slits 8. There are three of these radial slits 8 set at 120 degrees from each other, as can be seen from FIG. 2, and housed in each of them there is a spline 9 with an angled face 10 facing the interior of the tubular spindle 7 and a horizontal face 11 that is opposed to the angled face 10 and faces the exterior of the tubular spindle.

There is a piston 12 housed in the cylindrical chamber 5 with a piston rod 13 that runs axially in the interior of the tubular spindle 7 and whose end opposing the piston 12 has angled surfaces 14 that each act against corresponding angled faces 10 on the splines 9.

Externally to the tubular spindle 7 and in correspondence to each spline 9, there is a sector 15 with a grooved external surface 16 that comes into contact with the horizontal face 11 on the corresponding spline 9 via a rolling element, in this case consisting of a cylindrical roller 17, that fits into a housing 18 in the sector 15. As can be seen from FIG. 2, there are three sectors 15 with a grooved external surface 16 and an arc shaped cross-section. There is one sector 15 in correspondence to each spline 9, and consequently they are also set at 120 degrees from each other.

This method of construction permits each of the sectors 15 to move radially when the piston 13 moves in a horizontal direction 19 and the angled surfaces 14 on the end of the piston rod 13 press against the angled faces 10 of the splines 9, and the horizontal faces 11 of the splines 9 press against the cylindrical rollers 17.

Figure 3:
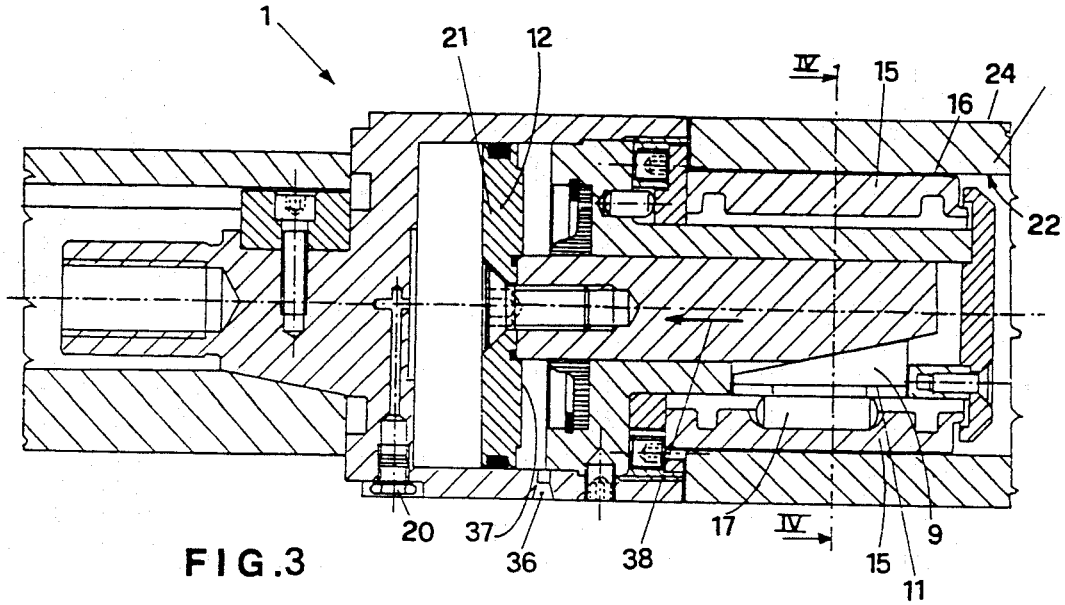
FIG. 3 is a lengthwise cross-section of the winding head in an expanded position.

In order to obtain the axial movement of the piston 12 and the piston rod 13 connected to it, the cylindrical chamber 5 in the external body 2 is connected to a compressed-air supply tube not shown in the figures via a duct 20. The compressed air acts against the front face 21 of the piston 12, and moves the piston rod 13 in the direction shown 19. The sectors 15 pressed radially by the splines 9 and the cylindrical rollers 17 expand so that their grooved surfaces 16 are forced against the internal surface 22 of the centre 23, and are in an open configuration as shown in FIG. 3.

It can thus be seen that in this situation the grooved surface 16 on each sector 15 grips the internal surface 22 of the tubular centre 23 in which it is inserted and around whose external surface 24 the paper tape is wound.

Figure 4:
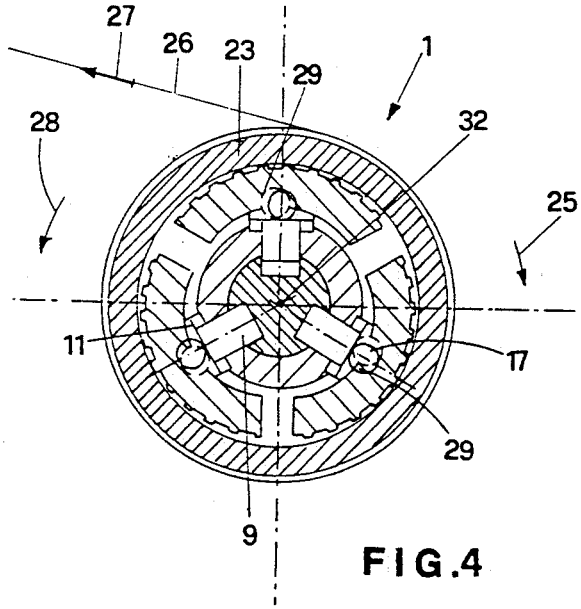
FIG. 4 is a transverse cross-section from IV to IV line of the winding head according to the invention shown in FIG. 3.
Figure 5:
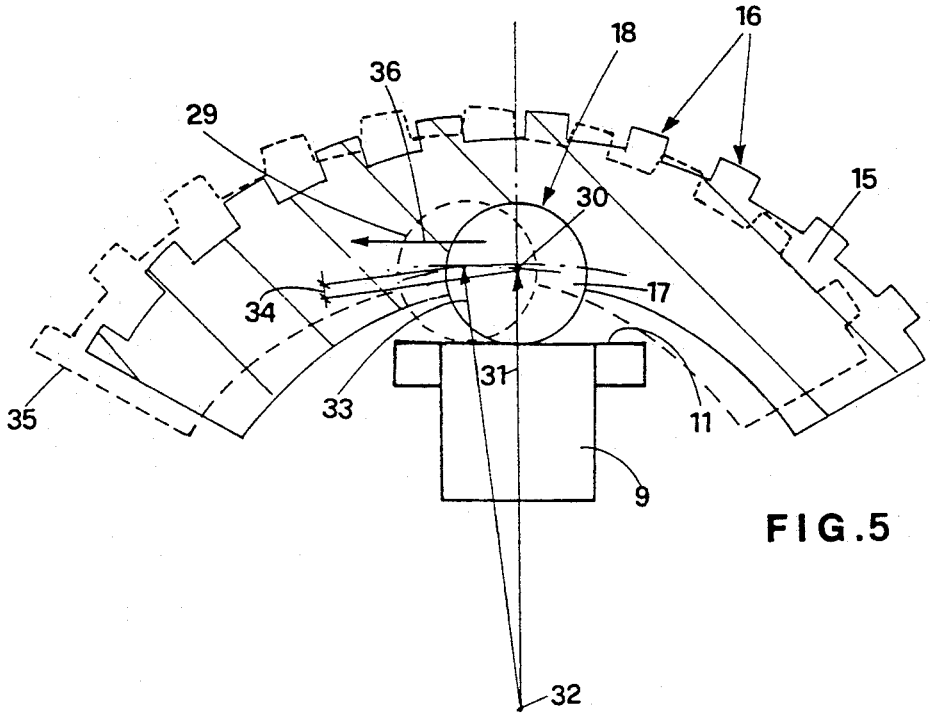
FIG. 5 is an enlarged view of a portion of FIG. 4 showing one of the rolling elements in contact with the horizontal face of the corresponding spline and the relative sector with a grooved external surface.

To prevent the tubular centre 23 from slipping against the sectors 15 during rotation, there is a cylindrical roller 17 between the horizontal face 11 on each spline 9 and the corresponding sector 15, that increases the adherence between the tubular centre 23 and the sectors 15 whilst the roll is being wound. As can be seen from FIG. 4, if the expanding winding head 1 rotates in a clockwise direction as shown by the arrow 25, the tape 26 being wound puts the tubular centre 23 on which it is being wound under stress in the direction indicated 27, which resists the rotation 25 and which tensions the tape 26, thus obtaining a compact roll. This causes an anticlockwise angular movement of the sectors 15, in the direction shown by the arrow 28, in other words in the opposite direction to that in which the winding head is rotating 25. This angular movement causes the cylindrical rollers 17 to roll on the horizontal faces 11 on each spline 9, and position themselves as shown by a dotted line 29 in FIG. 4. This situation is shown in greater detail in FIG. 5, where it can be seen that the rolling of each cylindrical roller 17 on the horizontal face 11 on each spline 9, moves the roller 17 in a horizontal direction 36 until it reaches the position shown by the dotted line 29. This also means that its centre 30 moves radially in respect of the centre 32 of the winding head from the position shown by the first radius 31 to that shown by the second 33, and its distance from the centre 32 of the winding head increases by the amount shown 34. When rolling, each cylindrical roller 17 can only follow the horizontal direction of the horizontal face 11, and thus when moving, its centre 30 does not move in an arc but in a horizontal line. As each roller 17 is fitted into a cavity 18 in its relative sector 15, it pushes the sector 15 radially outwards by the same amount 34, and moves into the position shown by a dotted line 35 in FIG. 5. This radial movement increases the grip between the grooved external surface 16 on each sector 15 and the internal surface 22 on the tubular centre 23. It is in fact this increase in radial movement that creates an increase in radial force thus obtaining a greater degree of adherence between the sectors 15 and the tubular centre 23 than the adherence obtainable by the sole action of the splines 9 pressed by the axial movement of the piston 12 and the piston rod 13.

The cylindrical chamber 5 has a second duct 36 on the rear side 37 of the piston 12. If the winding head is in the position shown in FIG. 3 and compressed-air is introduced via this duct 36, it acts on the rear face 37 of the piston 13 and causes it to retract in the direction shown 38 in FIG. 3. The air in contact with the front face 21 of the piston escapes through the duct 20, and the expanding winding head 1 returns to the condition shown in FIG. 1, so that the tubular centre 23 can be removed when the roll is fully wound.

The way the expanding winding head according to the invention achieves the aims set can be seen from that described.

It can in fact be seen that by placing a cylindrical roller 17 between each spline 9 and its corresponding sector 15 with a grooved external surface 16, the grip can be increased between the sector 15 and the internal surface 22 of the tubular centre 23 on which a roll is being wound, in respect of the degree of grip obtainable by the sole action of the splines 9 moved by the compressed-air force acting on the piston 12. Consequently, the expanding pneumatic winding head that is the subject of the invention obtains an increased degree of grip in respect of that obtained using a similarly sized equivalent winding head.

Figure 6:
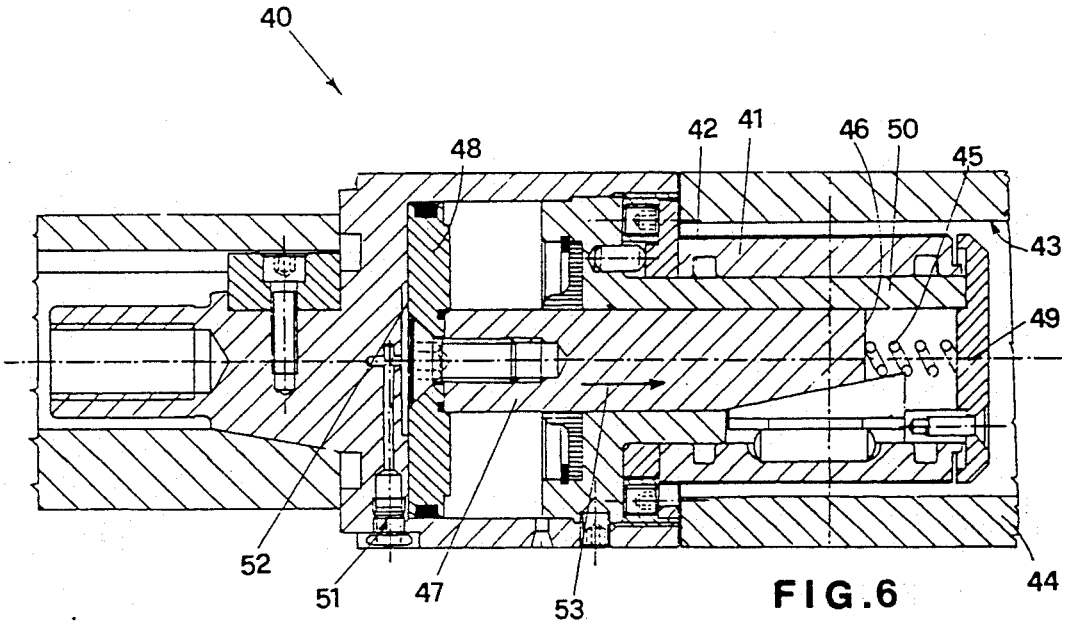
FIG. 6 shows a lengthwise cross-section of the winding head showing a variation to the means for returning the piston rod, in its rest position.

A variation to the construction of the winding head according to the invention is shown in FIG. 6. It can be seen that the return of the winding head 40 to an open position, i.e. with the sectors 41 with grooved external surfaces 42 not gripping the internal surface 43 of the tubular centre 44, is achieved by the use of a spring 45 placed between the head end 46 of the rod 47 on the piston 48 and a cover 49 placed at the front of the tubular spindle 50. In this way, the compressed-air entering through a duct 51 and acting on the front surface 52 of the piston 48, is only used to move the piston rod 47 in the direction shown 53 so that the sectors 41 grip the tubular centre 44. The return to an open position of the winding head is automatically achieved by the action of the spring 45 when the duct 51 is open and lets the air escape.

This variant also achieves the aims set.

Modifications may be made to the expanding winding head according to the invention during construction aimed at improving its performance or simplifying its construction.

Thus, for example, the rolling elements 17, which in the example described are cylindrical rollers, can be substituted by ball bearings. Also, the sectors 11, corresponding splines 9, and cylindrical rollers 17 can be other than three in number. Even the fluid used to operate the piston 12 may not be air.

It is however understood that all these possible variations are to be considered protected by the present invention.

I claim:

1. Expanding winding head particularly suited for winding paper tape in rolls, comprising:

an essentially cylinder shaped external body (2) having a tang (3) at one end adapted to be coupled to a drive shaft (4) and a cylindrical chamber (5), a tubular spindle (7, 50) having an end flange (6) and radial slits (8), said end flange (6) being positioned in said cylindrical chamber (5);

a plurality of splines (9) each fitted into one of said radial slits (8) in said tubular spindle (7; 50), each of said splines having an angled face (10) facing the interior of the tabular spindle (7; 50), and a horizontal face (11) facing the exterior of the tubular spindle (7; 50);

a plurality of sectors (15; 41) with a grooved external surface (16; 42) with an arc shaped cross-section, that are each coaxially externally attached to the tubular spindle (7; 50) in correspondence to one of the aforementioned splines (9), these sectors being designed to grip the interior of a tubular centre (23; 44) on which a roll is wound;

a piston (12; 48) housed and running in an axial direction within the cylindrical chamber (5) in the external body (2), with a piston rod (13; 47) that runs within the interior of the tubular spindle (7; 50), said piston rod (13; 47) having angled surfaces (14) on its end that act against the corresponding angle surfaces (10) on said splines (9);

means for driving the piston, rolling elements (17) attached to said sectors (15; 41) and placed between said sectors and the horizontal faces (11) of the splines (9), where the radial force of the sectors (15; 41) against the internal surface (22; 43) of the tubular centre (23; 44) is obtained by the radial movement of the splines (9) caused by the axial movement (19; 53) of the rod (13, 47) on the piston (12, 48) combined with the radial movement of the aforementioned rolling elements (17), when they are caused to roll on the horizontal face (11) of the spline (9), against which they buck the rotation of the sectors (15; 41) around the axis of the winding head (1; 40), this rotation being caused by the tension (27) of the tape (26) being wound around the tubular centre (23, 44).

2. Expanding winding head according to claim as in claim 1, wherein the rolling elements are cylindrical rollers (17).

3. Expanding winding head according to claim 1, wherein the rolling elements (17) are each fitted into a cavity (18) in each of the sectors (15; 41) with a grooved external surface (16; 42) in correspondence with its surface facing the external surface of the tubular spindle (7; 50) to which it is coupled.

4. Expanding winding head as in claim 1, wherein compressed air is used in said means for driving said piston (13; 48).

5. Expanding winding head according to claim 1, wherein spring means is provided to move the piston (13; 48) in a direction opposite to movement provided by said means for driving said piston said spring means being placed between and striking against a head end (46) of the rod (47) on the piston (48) and a cover (49) placed at the front of the tubular spindle (50).

* * * * *